US009341349B1

(12) United States Patent
Moore

(10) Patent No.: US 9,341,349 B1
(45) Date of Patent: May 17, 2016

(54) SYSTEMS, METHODS, AND DEVICES FOR PROVIDING A TORSION SPRING BRACKET ASSEMBLY FOR USE IN CYLINDRICAL LUMINAIRE HOUSINGS

(71) Applicant: Cooper Technologies Company, Houston, TX (US)

(72) Inventor: Michael Darrill Moore, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 48 days.

(21) Appl. No.: 13/887,108

(22) Filed: May 3, 2013

Related U.S. Application Data

(60) Provisional application No. 61/642,014, filed on May 3, 2012.

(51) Int. Cl.

| | |
|---|---|
| ***F21V 17/00*** | (2006.01) |
| ***F21V 19/00*** | (2006.01) |
| *F21V 17/02* | (2006.01) |
| *F21V 21/04* | (2006.01) |
| *F21V 21/08* | (2006.01) |
| *F21V 21/088* | (2006.01) |

(52) U.S. Cl.
CPC ..... *F21V 19/002* (2013.01); *F21V 17/00* (2013.01); *F21V 17/02* (2013.01); *F21V 19/003* (2013.01); *F21V 19/0015* (2013.01); *F21V 21/04* (2013.01); *F21V 21/044* (2013.01); *F21V 21/08* (2013.01); *F21V 21/088* (2013.01)

(58) Field of Classification Search
CPC ... F21V 21/088; F21V 21/085; F21V 21/041; F21V 21/042; F21V 21/043; F21V 21/044; F21V 21/045; F21V 21/046
USPC ..... 362/440, 445, 452, 457, 458, 364–370, 362/382, 389, 145, 147, 217.1–217.17, 655, 362/656, 249.02, 404, 406, 426; 248/225.21, 200, 300, 342
See application file for complete search history.

(56) References Cited

U.S. PATENT DOCUMENTS

| | | | | |
|---|---|---|---|---|
| 6,364,511 | B1 * | 4/2002 | Cohen | 362/368 |
| 7,059,745 | B2 * | 6/2006 | Gordin et al. | 362/655 |
| 7,628,504 | B2 * | 12/2009 | Glickman | 362/148 |
| 2002/0167257 | A1 * | 11/2002 | Shen | 313/318.01 |
| 2003/0160141 | A1 * | 8/2003 | Yamanashi | 248/300 |
| 2007/0223233 | A1 * | 9/2007 | Teng | 362/362 |
| 2009/0039799 | A1 * | 2/2009 | Newman, Jr. et al. | F21S 8/02 315/291 |
| 2009/0244911 | A1 * | 10/2009 | Schapira et al. | 362/382 |
| 2009/0296403 | A1 * | 12/2009 | Zhang et al. | 362/294 |
| 2010/0002444 | A1 * | 1/2010 | Konaka | 362/294 |

(Continued)

*Primary Examiner* — Evan Dzierzynski
*Assistant Examiner* — Zheng Song
(74) *Attorney, Agent, or Firm* — King & Spalding LLP

(57) ABSTRACT

A mounting bracket assembly includes a mounting base and a plurality of arms extending down from the mounting base. A first arm of the plurality of arms includes a first pair of inwardly facing hooks coupled to the first arm and defining a first torsion spring receiver area. The first arm of the plurality of arms includes a first spring coil ramp disposed along a bottom end of the first arm and extending radially inward from the first arm at a first angle. A second arm of the plurality of arms includes a second pair of inwardly facing hooks coupled to the second arm and defining a second torsion spring receiver area. The second arm of the plurality of arms includes a second spring coil ramp disposed along a bottom end of the second arm and extending radially inward from the second arm at a second angle.

20 Claims, 7 Drawing Sheets

(56) References Cited

U.S. PATENT DOCUMENTS

2011/0063849 A1* 3/2011 Alexander et al. ..... 362/294
2011/0134650 A1* 6/2011 Verma et al. ..... 362/362
2011/0149552 A1* 6/2011 Atalay ..... 362/92
2012/0300484 A1* 11/2012 Mochizuki et al. ..... 362/512
2013/0039037 A1* 2/2013 Drury ..... 362/101
2013/0271979 A1* 10/2013 Pearson et al. ..... 362/235

* cited by examiner

SYSTEMS, METHODS, AND DEVICES FOR PROVIDING A TORSION SPRING BRACKET ASSEMBLY FOR USE IN CYLINDRICAL LUMINAIRE HOUSINGS

RELATED APPLICATIONS

The present application claims priority to U.S. Provisional Patent Application No. 61/642,014, filed May 3, 2012, and titled "Systems, Methods, And Devices For Providing A Torsion Spring Bracket Assembly For Use In Cylindrical Luminaire Housings," the entire content of which is incorporated herein by reference.

TECHNICAL FIELD

The present disclosure relates generally to lighting solutions, and more particularly to systems, methods, and devices for providing a torsion spring bracket for use in surface cylinder fixtures.

BACKGROUND

Torsion springs typically require sufficient space to expand and hold a trim in place. Due to surface cylinder housing construction, there typically is not enough free space available for torsion spring expansion. Another challenge to the use of torsion springs in surface cylinder housings is the removal of the trim assembly that is attached or held in place with torsion springs. In many cases, as the trim assembly is being pulled through the opening of the surface cylinder housing, the spring coil for the torsion spring can hit the edge or lip portion of the surface cylinder housing, making removal more difficult.

BRIEF DESCRIPTION OF THE FIGURES

Reference will now be made to the accompanying drawings, which are not necessarily drawn to scale, and wherein.

Figure 1A:
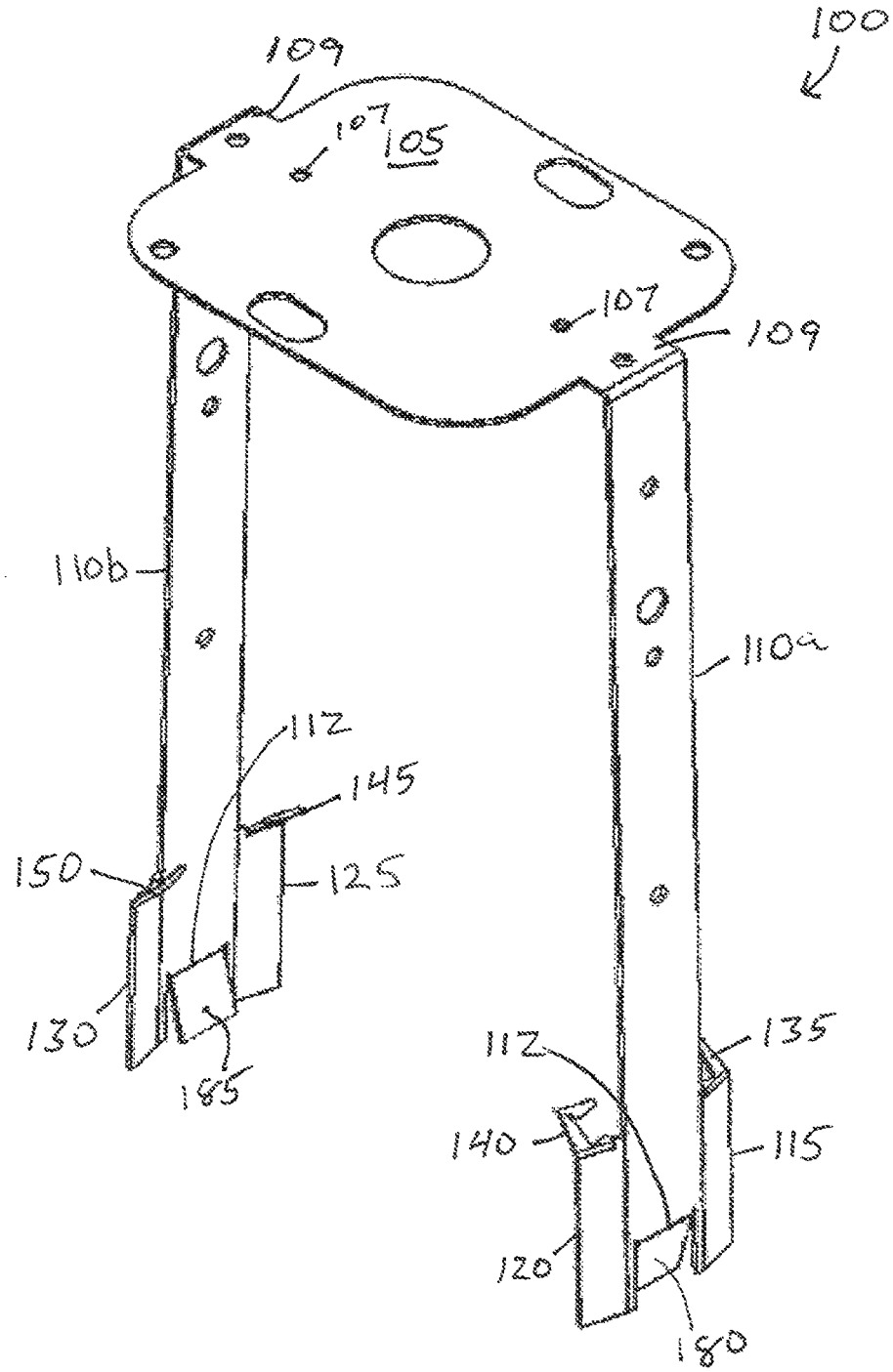
FIG. 1A is a perspective view of a torsion spring bracket in accordance with an example embodiment.
Figure 1B:
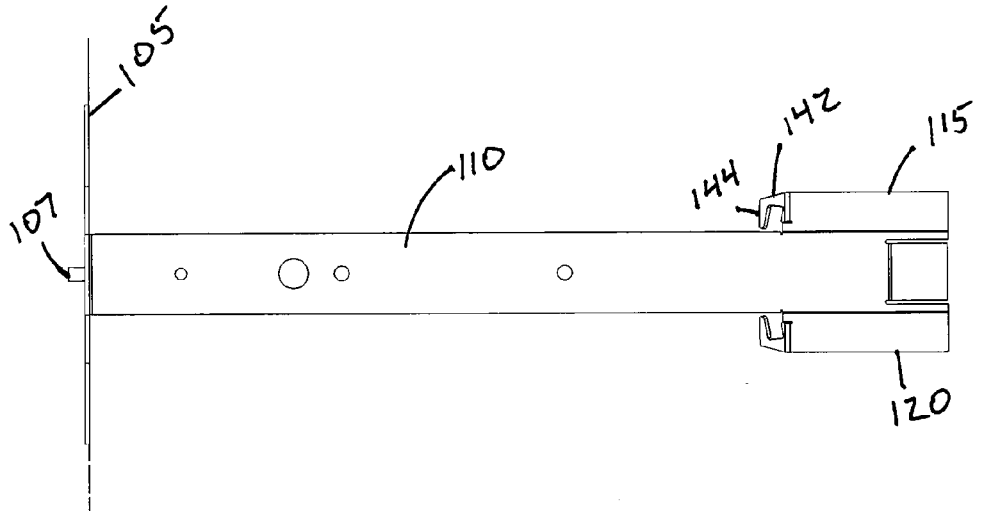
FIG. 1B is a side elevation view of the torsion spring bracket of FIG. 1A in accordance with an example embodiment.
Figure 1C:
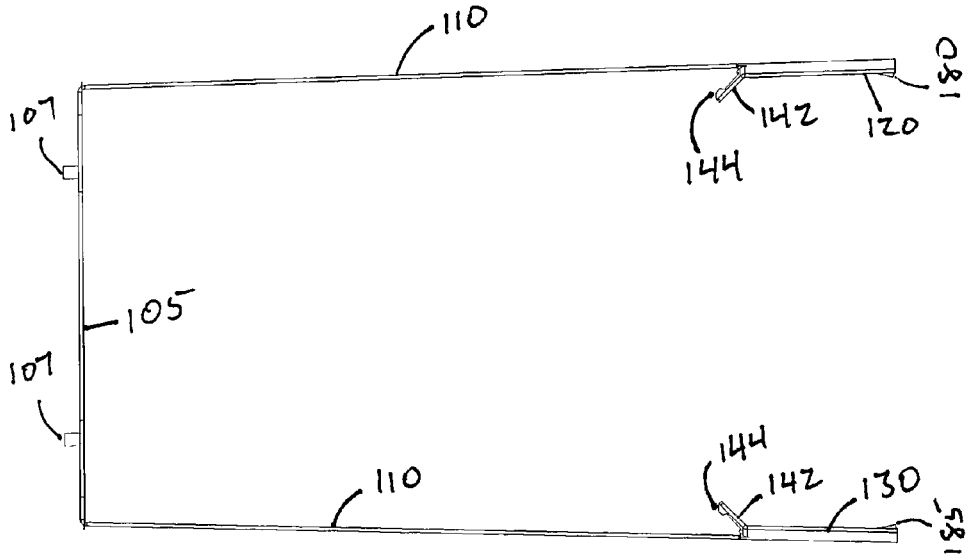
FIG. 1C is a front elevation view of the torsion spring bracket of FIGS. 1A-B in accordance with an example embodiment.
Figure 1D:
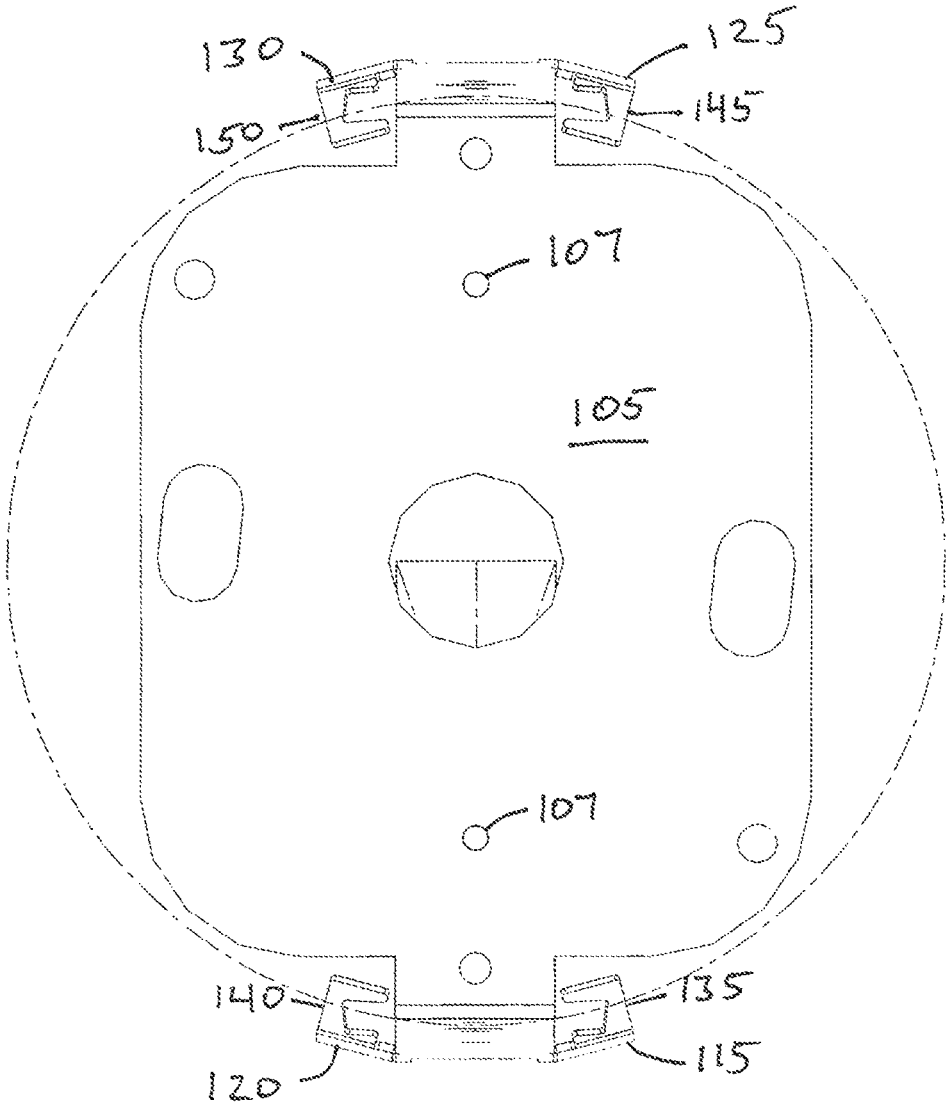
FIG. 1D is a top plan view of the torsion spring bracket of FIGS. 1A-C in accordance with an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

SUMMARY

The present disclosure relates to systems, methods, and devices for providing a torsion spring bracket for use in surface cylinder fixtures. In an example embodiment, a mounting bracket assembly includes a mounting base and a plurality of arms extending down from the mounting base. A first arm of the plurality of arms includes a first pair of inwardly facing hooks coupled to the first arm and defining a first torsion spring receiver area. The first arm of the plurality of arms includes a first spring coil ramp disposed along a bottom end of the first arm and extending radially inward from the first arm at a first angle. A second arm of the plurality of arms includes a second pair of inwardly facing hooks coupled to the second arm and defining a second torsion spring receiver area. The second arm of the plurality of arms includes a second spring coil ramp disposed along a bottom end of the second arm and extending radially inward from the second arm at a second angle.

In another example embodiment, a light fixture module includes a housing and a mounting bracket assembly coupled to and positioned within the housing. The mounting bracket assembly includes a mounting base and a plurality of arms extending down from the mounting base. A first arm of the plurality of arms includes a first pair of inwardly facing hooks coupled to the first arm and defining a first torsion spring receiver area. The first arm of the plurality of arms also includes a first spring coil ramp disposed along a bottom end of the first arm and extending radially inward from the first arm at a first angle. A second arm of the plurality of arms includes a second pair of inwardly facing hooks coupled to the second arm and defining a second torsion spring receiver area. The second arm of the plurality of arms also includes a second spring coil ramp disposed along a bottom end of the second arm and extending radially inward from the second arm at a second angle.

In another example embodiment, a light fixture includes a housing, a mounting bracket assembly coupled to and positioned within the housing, and a light module including a light engine, wherein the light module is coupled to the mounting bracket assembly. The mounting bracket assembly includes a mounting base and a plurality of arms extending down from the mounting base. A first arm of the plurality of arms includes a first pair of inwardly facing hooks coupled to the first arm and defining a first torsion spring receiver area. The first arm of the plurality of arms also includes a first spring coil ramp disposed along a bottom end of the first arm and extending radially inward from the first arm at a first angle. The mounting bracket assembly includes a second arm of the plurality of arms including a second pair of inwardly facing hooks coupled to the second arm and defining a second torsion spring receiver area. The second arm of the plurality of arms also includes a second spring coil ramp disposed along a bottom end of the second arm and extending radially inward from the second arm at a second angle.

These and other aspects, objects, features, and embodiments will be apparent from the following description and the appended claims.

DETAILED DESCRIPTION OF EXAMPLE EMBODIMENTS

Example embodiments disclosed herein are directed to a luminaire having a cylinder housing designed to receive an LED light module or for use with an LED light module. For example, the cylinder housing (hereinafter referred to as a "surface cylinder housing") may be a surface-mounted, a wall-mounted, a pendant-mounted, or a cable-mounted housing usable in a corresponding luminaire. The example embodiments provide the capability to use torsion spring assemblies to install and remove the LED light module from within the surface cylinder housing that is usable in a corresponding surface-mounted, wall-mounted, pendant-mounted, or cable-mounted luminaire.

FIGS. 1A-D present various views of a torsion spring bracket assembly 100 in accordance with an example embodiment. Referring now to FIGS. 1A-D, the example torsion spring bracket assembly 100 includes a mounting base 105 and one or more arms 110 extending away from the mounting base 105. The example base 105 is planar or substantially planar and includes a top surface and opposing bottom surface. The top surface includes a pair of mounting posts 107 extending up orthogonally from the top surface of the mounting base 105. In certain example embodiments, each mounting post 107 is threaded and designed to be positioned through a ceiling member of a surface cylinder housing to couple the torsion spring bracket assembly 100 to the surface cylinder housing, as described below. The mounting base 105 can also include one or more apertures extending through the surface of the mounting base 105 for removably coupling additional components, such as LED drivers.

In one example embodiment, the assembly 100 includes two arms 110*a* and 110*b* that extend orthogonally or substantially orthogonally down from the base 105. The base 105 can include a pair of tabs 109 that extend out from the base along the same plane and the arms 110*a* and 110*b* can be attached and extend down from these tabs 109. In such a case, the tabs 109 are considered part of the base 105. In alternative embodiments, each arm 110*a*, 110*b* extends angularly out from the bottom side of the base 105. The angle can be in the range of 0.1-30 degrees off of vertical in this alternative embodiment. In certain example embodiments, each arm 110*a*, 110*b* is disposed on an opposing side of the base 105. In addition, the arms 110*a* and 110*b* extend along parallel planes in certain example embodiments.

Each arm 110*a*, 110*b* has a flat or substantially flat planar surface that includes a first end coupled to the base 105 and a distal second end. A pair of flange members 115, 120 can extend out from the first arm 110*a* in an area adjacent to the arm's second end and another pair of flange members 125, 130 can extend out from the second arm 110*b* in an area adjacent to that arm's second end. In certain example embodiments, each respective pair of flange members 115, 120 and 125, 130 are positioned along opposite longitudinal edges of the respective arm 110*a*, 110*b*. In certain example embodiments, each flange member 115-130 is coupled to and extends angularly from the respective arm 110*a*, 110*b*. The angle the flange members 115-130 are positioned with respect to the respective arm 110*a*, 110*b* can generally correspond to the radius of curvature of the inner surface of the surface cylinder housing that the assembly 100 is coupled to and can range from 0-45 degrees in certain example embodiments. In certain example embodiments, the flange members 115-130 are integrally formed with their respective arms 110*a*, 110*b*.

Each flange member 115-130 can have a first end, a distal second end and a substantially planar surface disposed between the first and second ends. In certain example embodiments, the second end of each flange member 115-130 is adjacent to the second end of the respective arm 110. Positioned along the first end of each flange member 115-130 is a torsion spring receiver hook 135, 140, 145, 150. In alternative embodiments, each hook 135, 140, 145, 150 is coupled and extends from the respective arm 110 and eliminates the need for the flange members 115-130. Each hook 135, 140, 145, 150 can include a first member 142 extending angularly out from the first end of the respective flange member 115-130 and a second member 144 extending angulary or orthogonally from the first member. In one example embodiment, the first member 142 is positioned at an angle of about 45 degrees from vertical with respect to its respective flange member 115-130. In other example embodiments, the angle of the first member 142 ranges from 1-90 degrees from vertical. Each pair of hooks 135, 140 and 145, 150 face inward toward each other in certain example embodiments. An opening is defined by the ends of the second members 144 of each pair of hooks that leads to a torsion spring receiver area that is defined by the arm 110 respective flange members 115, 120 or 125, 130 and the inner edges of the respective pairs of hooks 135, 140 or 145, 150.

Figure 4:
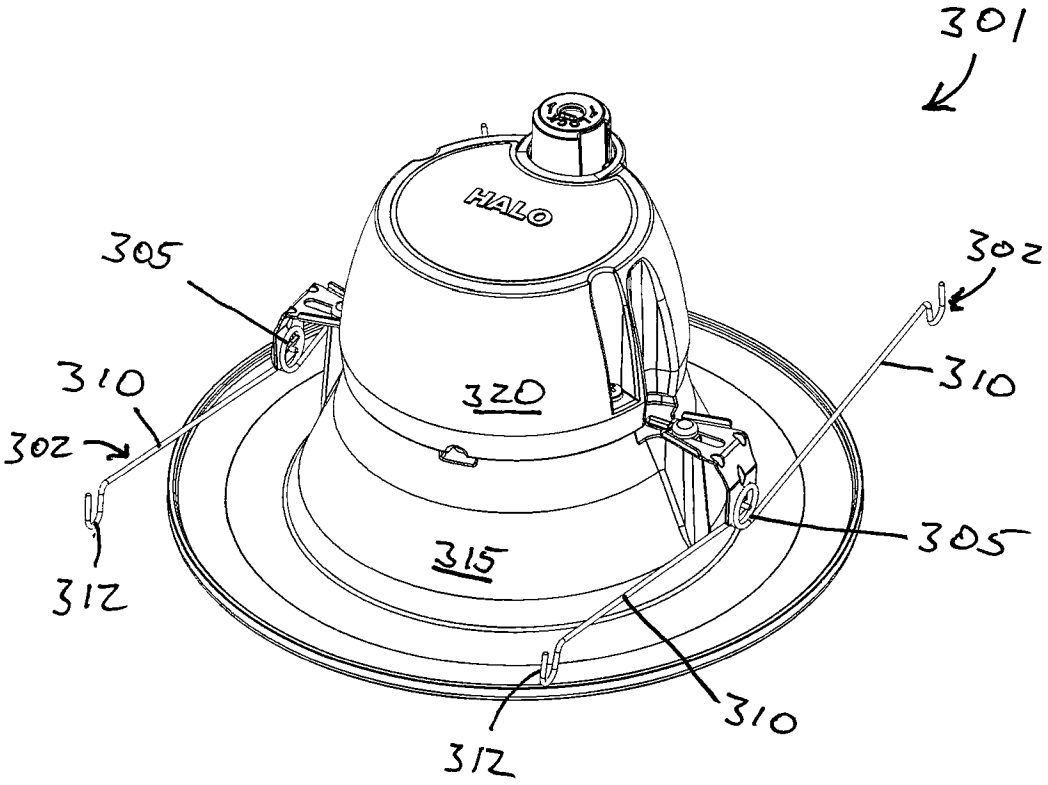
FIG. 4 is a perspective view of an example light emitting diode (LED) light module for use with the torsion spring bracket of FIGS. 1A-D in accordance with an example embodiment.

The torsion spring bracket assembly 100 of FIGS. 1A-1D may be used to attach a light module, such an example light module shown in FIG. 4. FIG. 4 is a perspective view of an example LED light module 301 with torsion springs that can be installed into the torsion spring bracket assembly 100. Referring to FIGS. 1A-D and 4, the LED light module 301 includes a light engine 320 and a trim 315 coupled to the light engine 320. In certain example embodiments, the trim 315 is removably coupled to the light engine 320. Torsion springs 302 can be positioned and coupled to opposing sides of the light engine 320, either directly or through the use of a bracket (as shown). Each example torsion spring 302 includes a spring coil 305 and shafts 310 extending away from the spring coil 305. Each shaft 310 can include a hook-shaped feature 312 at the distal end of the shaft 310.

In general a user can install the light module 301 into the assembly 100 within a surface cylinder housing by squeezing the two ends of respective shafts 310 together and inserting the shafts 310 through the opening defined by the ends of the corresponding second members 144 and inserting the shafts 310 into the torsion spring receiver area. By squeezing the two ends 312 of the shafts 310 together, the spring coil 305 is twisted tighter, resulting in a force that attempts to cause the ends 312 to retract or move away from one-another while in the torsion spring receiver area. When the shafts 310 contact the inner edges of the hooks 135, 140, 145, 150, while continuing to retract, it can cause the torsion spring 302 to help lift the light module 301 into the surface cylinder housing and maintain the light module 301 within the surface cylinder housing.

Figure 3:
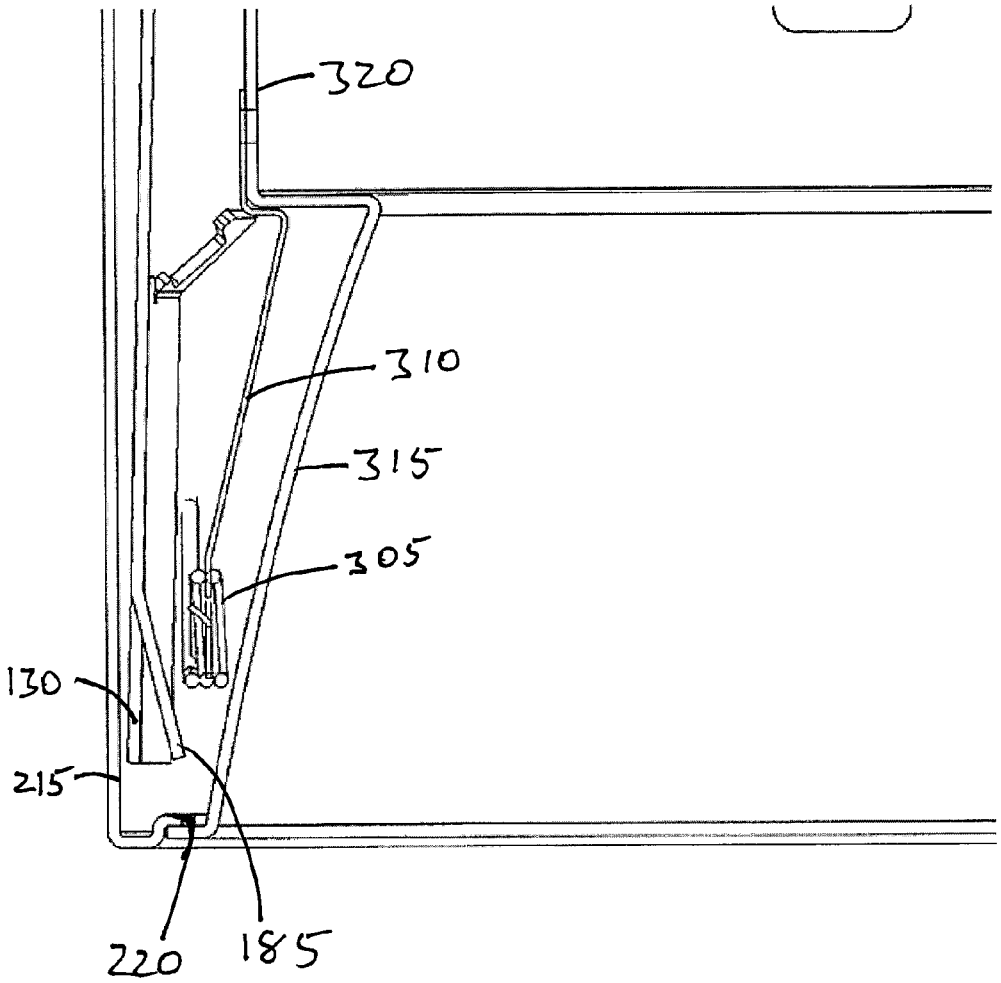
FIG. 3 is a partial cross-sectional view of an interaction of the torsion spring bracket of FIGS. 1A-D with a light module and trim assembly having torsion springs in accordance with an example embodiment.

Positioned near the bottom of the second end of each arm 110 is a spring coil ramp 180. In certain example embodiments, the spring coil ramp 180, 185 is formed from a portion of the respective arm 110. Alternatively, the spring coil ramp 180, 185 is a tab-like member coupled to or near the bottom of the second end of the arm 110. Each example spring coil ramp 180, 185 extends angularly inward from it respective arm 110. For example, spring coil ramp 180 extends angularly inward from arm 110*a* and spring coil ramp 185 extends angularly inward from arm 110*b*. In one example embodiment, each spring coil ramp 180, 185 is angled about 10 degrees from the surface of its respective arm 110. In an alternative embodiment, the length and angle of each spring coil ramp 180, 185 is configured such that the inner surface of the end of each respective ramp 180, 185 extends to a point radially equal to or a little less than the lip portion 220 extending from the wall 215 of the can housing, as best shown in FIG. 3.

Figure 2:
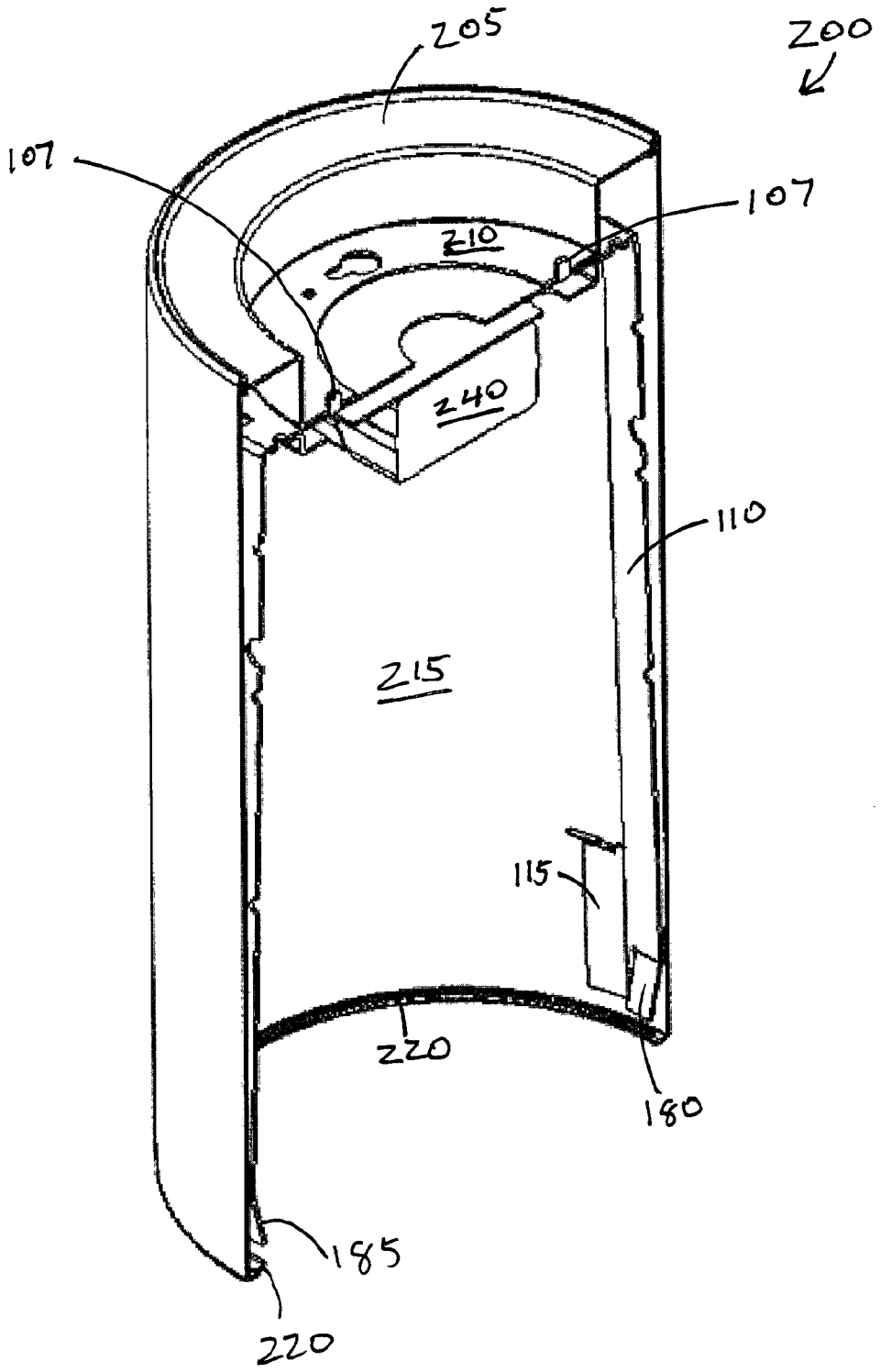
FIG. 2 is a cross-sectional view of the torsion spring bracket of FIGS. 1A-D installed in a surface cylinder housing in accordance with an example embodiment.

FIG. 2 is a cross-sectional view of the torsion spring bracket assembly 100 of FIGS. 1A-D installed in a surface cylinder housing 200 in accordance with an example embodiment. Now referring to FIGS. 1A-2, the example torsion spring bracket assembly 100 can be installed in a surface cylinder housing, such as the surface cylinder housing 200 of FIG. 200. The surface cylinder housing 200 can have a substantially cylindrical shape and can include a top end 205 that includes a mounting surface 210 and an outer wall 215 generally extending down from the top end 205. A lip portion 220 can extend radially inward from the outer wall 215.

The mounting posts 107 of the assembly 100 can extend through openings in the mounting surface 210 to couple the mounting base 105 to the mounting surface 210. On or more types of coupling devices, such as nuts, can be threadably coupled to each post 107 to couple the mounting base 105 to the mounting surface 210. In addition, an LED driver 240 or other electrical components can be coupled to the bottom side of the mounting base 105. Each arm 110 can be positioned generally along the outer wall 215 and extend down towards the lip portion 220 and the bottom of the surface cylinder housing 220.

As shown in FIG. 2, in some example embodiments, the LED driver 240 is coupled to the torsion spring bracket assembly 100, where the torsion spring bracket assembly 100 may provide an electrical ground path for electricity related to the LED driver 240. For example, the torsion spring bracket assembly 100 may be made from a metal (e.g., aluminum) and, as a conductor, may be used to provide an electrical ground path for the LED driver 240 and/or other electrical components that are coupled to it.

In some example embodiments, the torsion spring bracket assembly 100 may serve as a heat conduit to transfer heat from, for example, the LED driver 240 to the surface cylinder housing 200. As shown in FIGS. 2 and 3, because the torsion spring bracket assembly 100 is in physical contact with the surface cylinder housing 200 as well as with the LED driver 240, the torsion spring bracket assembly 100 may provide a heat transfer path between the LED driver 240 and the surface cylinder housing 200. For example, the torsion spring bracket assembly 100 may be made from a metal such as aluminum for efficient heat transfer and may operate as part of a luminaire's heat sink.

FIG. 3 is a partial cross-sectional view showing the interaction of the torsion spring coil from a light module 301 and one of the spring coil ramps 185, as the light module 301 is being removed from the can housing. During removal, after the ends 312 of the shafts 310 are moved together to remove the shafts 310 from the torsion spring receiver area, the light module 301, including the light engine 320 and trim 315, are moved downward towards the opening in the can housing. The spring coil 305 moves down and along an area adjacent to the arm 110 and as it approaches the bottom of the arm 110 it can contact the spring coil ramp 185 if the spring coil 305 is too close to the wall 215 of the can housing. Contacting the ramp 185 forces the spring coil 305 back towards the center of the opening and away from the lip 220 of the housing, thereby reducing the possibility the coil 305 catches on the lip 220 during removal of the light module 301.

In alternative embodiments, the spring coil ramp 180, 185 can be positioned at an angle anywhere between 1-60 degrees. In certain exemplary embodiments, the bottom edge of the spring coil ramp 180, 185 is at substantially the same vertical position as the second end of the flange members 115-130.

Although the present disclosure describes the example embodiments, it should be appreciated by those skilled in the art that various modifications are well within the scope of this disclosure. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments will suggest themselves to practitioners of the art. Therefore, the scope of the claims presented below is not limited herein.

What is claimed is:

1. A mounting bracket assembly for installing a light module in a luminaire housing, the mounting bracket assembly comprising:

a mounting base; and a plurality of arms extending down from the mounting base, wherein a first arm of the plurality of arms comprises a first pair of inwardly facing hooks defining a first torsion spring receiver area, wherein a first flange member is coupled to a first longitudinal edge of the first arm and extends radially inward from the first arm, wherein a second flange member is coupled to a second longitudinal edge of the first arm and extends radially inward from the first arm, the first longitudinal edge and the second longitudinal edge being opposite edges of the first arm, wherein a second arm of the plurality of arms comprises a second pair of inwardly facing hooks defining a second torsion spring receiver area, wherein an end portion of a first hook of the first pair of inwardly facing hooks extends toward a second hook of the first pair of inwardly facing hooks, wherein an end portion of the second hook of the first pair of inwardly facing hooks extends toward the first hook of the first pair of inwardly facing hooks, wherein the first hook of the first pair of inwardly facing hooks is coupled to and extends angularly from a top edge of the first flange member such that the first flange member is below the first hook, and wherein the second hook of the first pair of inwardly facing hooks is coupled to and extends angularly from a top edge of the second flange member such that the second flange member is below the second hook.

2. The mounting bracket assembly of claim 1, wherein the first arm and the second arm extend down from the mounting base at opposite edges of the mounting base.

3. The mounting bracket assembly of claim 1, further comprising mounting posts extending upwardly from a surface of the mounting base, wherein the mounting posts are configured to attach the mounting bracket assembly to a housing.

4. The mounting bracket assembly of claim 1, wherein the first arm comprises a first spring coil ramp disposed at a bottom most end of the first arm and extending radially inward from the first arm at a first angle, and wherein the second arm comprises a second spring coil ramp disposed at a bottom most end of the second arm and extending radially inward from the second arm at a second angle.

5. The mounting bracket assembly of claim 1, wherein the mounting base has a substantially circular shape configured to be positioned within a cylindrical light fixture housing.

6. The mounting bracket assembly of claim 1, wherein the mounting base includes a plurality of tabs and wherein each arm of the plurality of arms extends down from a respective tab of the plurality of tabs.

7. The mounting bracket assembly of claim 1, wherein a light emitting diode (LED) driver is attached to the mounting base and wherein the LED driver is positioned on a side of the mounting base facing the first pair of inwardly facing hooks and the second pair of inwardly facing hooks.

8. The mounting bracket assembly of claim 1, wherein:

a third flange member is coupled to a first longitudinal edge of the second arm, wherein a first hook of the second pair of inwardly facing hooks is coupled to and extends angularly from the third flange member; and a fourth flange member is coupled to a second longitudinal edge of second arm, the first longitudinal edge of the second arm and the second longitudinal edge of the second arm being opposite edges of the second arm, wherein a second hook of the second pair of inwardly facing hooks is coupled to and extends angularly from the fourth flange member.

9. The mounting bracket assembly of claim 8, wherein first flange member and the second flange member are integrally formed with the first arm and wherein the third flange member and the fourth flange member are integrally formed with the second arm.

10. A light fixture module, comprising:

a housing; and a mounting bracket assembly coupled to and positioned within the housing, the mounting bracket assembly comprising:

a mounting base; and a plurality of arms extending down from the mounting base, wherein a first arm of the plurality of arms comprises a first pair of inwardly facing hooks defining a first torsion spring receiver area, wherein a first flange member is coupled to a first longitudinal edge of the first arm and extends radially inward from the first arm, wherein a second flange member is coupled to a second longitudinal edge of the first arm and extends radially inward from the first arm, the first longitudinal edge and the second longitudinal edge being opposite edges of the first arm, wherein a second arm of the plurality of arms comprises a second pair of inwardly facing hooks defining a second torsion spring receiver area, wherein an end portion of a first hook of the first pair of inwardly facing hooks extends toward a second hook of the first pair of inwardly facing hooks, wherein an end portion of the second hook of the first pair of inwardly facing hooks extends toward the first hook of the first pair of inwardly facing hooks, wherein the first hook of the first pair of inwardly facing hooks is coupled to and extends angularly from a top edge of the first flange member such that the first flange member is below the first hook, and wherein the second hook of the first pair of inwardly facing hooks is coupled to and extends angularly from a top edge of the second flange member such that the second flange member is below the second hook.

11. The light fixture module of claim 10, wherein the mounting bracket assembly further comprises mounting posts extending upwardly from a surface of the mounting base, wherein each of the mounting posts extends through a corresponding aperture in a mounting surface of the housing.

12. The light fixture module of claim 11, wherein a respective coupling device is attached to each mounting post to couple the mounting bracket assembly to the housing.

13. The light fixture module of claim 10, wherein a light emitting diode (LED) driver is attached to the mounting base and wherein the LED driver is positioned on a side of the mounting base facing the first pair of inwardly facing hooks and the second pair of inwardly facing hooks.

14. The light fixture module of claim 10, wherein the first arm comprises a first spring coil ramp disposed at a bottom most end of the first arm and extending radially inward from the first arm at a first angle, and wherein the second arm comprises a second spring coil ramp disposed at a bottom most end of the second arm and extending radially inward from the second arm at a second angle.

15. The light fixture module of claim 10, wherein:

a first flange member is coupled to a first longitudinal side of the first arm, wherein a first hook of the first pair of inwardly facing hooks is coupled to and extends angularly from the first flange member;

a second flange member is coupled to a second longitudinal side of the first arm opposite the first longitudinal side of the first arm, wherein a second hook of the first pair of inwardly facing hooks is coupled to and extends angularly from the second flange member;

a third flange member is coupled to a first longitudinal side of the second arm, wherein a first hook of the second pair of inwardly facing hooks is coupled to and extends angularly from the third flange member; and a fourth flange member is coupled to a second longitudinal side of second arm opposite the first longitudinal side of the second arm, wherein a second hook of the second pair of inwardly facing hooks is coupled to and extends angularly from the fourth flange member.

16. A light fixture, comprising:

a housing;

a mounting bracket assembly coupled to and positioned within the housing, the mounting bracket assembly comprising:

a mounting base; and a plurality of arms extending down from the mounting base, wherein a first arm of the plurality of arms comprises a first pair of inwardly facing hooks defining a first torsion spring receiver area, wherein a first flange member is coupled to a first longitudinal edge of the first arm and extends radially inward from the first arm, wherein a second flange member is coupled to a second longitudinal edge of the first arm and extends radially inward from the first arm, the first longitudinal edge and the second longitudinal edge being opposite edges of the first arm, wherein a second arm of the plurality of arms comprises a second pair of inwardly facing hooks defining a second torsion spring receiver area, wherein an end portion of a first hook of the first pair of inwardly facing hooks extends toward a second hook of the first pair of inwardly facing hooks, wherein an end portion of the second hook of the first pair of inwardly facing hooks extends toward the first hook of the first pair of inwardly facing hooks, wherein the first hook of the first pair of inwardly facing hooks is coupled to and extends angularly from a top edge of the first flange member such that the first flange member is below the first hook, and wherein the second hook of the first pair of inwardly facing hooks is coupled to and extends angularly from a top edge of the second flange member such that the second flange member is below the second hook; and a light module including a light engine, the light module attachable to the mounting bracket assembly.

17. The light fixture of claim 16, wherein a first torsion spring is attached to the light engine at a first side of the light engine and wherein a second torsion spring is attached to the light engine at second first side of the light engine opposite the first side.

18. The light fixture of claim 16, wherein the light module is attachable to the mounting bracket assembly by positioning the first torsion spring in the first torsion spring receiver area and by positioning the second torsion spring in the second torsion spring receiver area.

19. The light fixture of claim 16, wherein a light emitting diode (LED) driver is attached to the mounting base of the mounting bracket assembly and wherein the LED driver is positioned on a side of the mounting base facing the first pair of inwardly facing hooks and the second pair of inwardly facing hooks.

20. The light fixture of claim 16, wherein the first arm comprises a first spring coil ramp disposed at a bottom most end of the first arm and extending radially inward from the first arm at a first angle, and wherein the second arm comprises a second spring coil ramp disposed at a bottom most end of the second arm and extending radially inward from the second arm at a second angle.

* * * * *